US009717335B2

(12) United States Patent
Zhang

(10) Patent No.: US 9,717,335 B2
(45) Date of Patent: Aug. 1, 2017

(54) DRAWER STOP MECHANISM FOR SLIDING DRAWER

(71) Applicant: Jiangsu Tongrun Equipment Technology Co., Ltd., Suzhou, Jiangsu (CN)

(72) Inventor: Feng Zhang, Jiangsu (CN)

(73) Assignee: Jiangsu Tongrun Equipment Technology Co., Ltd., Suzhou, Jiangsu (CN)

( * ) Notice: Subject to any disclaimer, the term of this patent is extended or adjusted under 35 U.S.C. 154(b) by 0 days.

(21) Appl. No.: 15/232,924

(22) Filed: Aug. 10, 2016

(65) Prior Publication Data

US 2017/0150815 A1 Jun. 1, 2017

(30) Foreign Application Priority Data

Nov. 27, 2015 (CN) ..... 2015 2 0959109 U

(51) Int. Cl.
*A47B 95/02* (2006.01)
*A47B 88/16* (2006.01)
*A47B 95/00* (2006.01)

(52) U.S. Cl.
CPC ..... *A47B 88/16* (2013.01); *A47B 95/00* (2013.01)

(58) Field of Classification Search
CPC ..... A47B 95/02; A47B 88/047
USPC ..... 312/332.1, 333; 292/126
See application file for complete search history.

(56) References Cited

U.S. PATENT DOCUMENTS

| | | | | |
|---|---|---|---|---|
| 6,547,289 | B1 * | 4/2003 | Greenheck | A47B 88/0044 292/100 |
| 7,552,950 | B2 * | 6/2009 | Scheffy | E05B 65/46 292/100 |
| 8,491,068 | B2 * | 7/2013 | Weng | A47B 88/40 312/332.1 |
| 8,608,261 | B2 * | 12/2013 | Retchloff | E05B 65/46 312/332.1 |
| 9,388,609 | B2 * | 7/2016 | Grela | E05C 3/14 |
| 2006/0103278 | A1 * | 5/2006 | Bousquet | B25H 3/028 312/332.1 |
| 2008/0150407 | A1 * | 6/2008 | Mehmen | E05B 65/46 312/332.1 |
| 2011/0121701 | A1 * | 5/2011 | Chang | E05B 7/00 312/332.1 |

* cited by examiner

*Primary Examiner* — Matthew Ing
(74) *Attorney, Agent, or Firm* — Juan Carlos A. Marquez; Marquez IP Law Office PLLC

(57) ABSTRACT

The present invention provides a drawer stop mechanism for a sliding drawer, and the drawer stop mechanism is assembled on a drawer panel of the sliding drawer. The drawer stop mechanism includes an upper decoration strip, a lower decoration strip, at least one spring and at least one lock hook. The upper decoration strip is fixed on the drawer panel. The lower decoration strip is movably connected with the upper decoration strip by a pivot. The at least one spring is mounted between the upper decoration strip and the lower decoration strip. The at least one lock hook is fixed at the lower decoration strip. The drawer stop mechanism provided by the present invention has a simple structure, is easy to use and can lock the drawer perfectly.

4 Claims, 4 Drawing Sheets

DRAWER STOP MECHANISM FOR SLIDING DRAWER

BACKGROUND OF THE INVENTION

1. Technical Field

The present invention relates to a cabinet structure; in particular, to a drawer stop mechanism for a sliding drawer.

2. Description of Related Art

For some cabinets having drawers used in portable tool boxes, motorcycles or office desks, the drawer can be easily withdrawn for the ease of use. However, without any locking mechanism, the drawer may be slide out because an external force is suddenly applied. For example, if the drawer is heavily loaded, the drawer may suddenly slide out and the cabinet may also fall down, which is not safe for users.

Currently, there are two ways to prevent the drawer from suddenly sliding out. One is to use a key to lock the drawer, and the other one is to assemble a mechanical locking mechanism on the drawer to lock or unlock the drawer without using keys. For the former one, it may be sometimes inconvenient because it must use a key to lock or unlock the drawer. For the later one, the commonly used mechanical locking mechanisms have complex structures, and do not have great liability.

SUMMARY OF THE INVENTION

The present invention provides a drawer stop mechanism for a sliding drawer. It helps a user to open and close the drawer more easily. In addition, it has a simple structure to be easily used and to lock the drawer perfectly.

The drawer stop mechanism provided by the present invention is assembled on a drawer panel of the sliding drawer, and comprises an upper decoration strip, a lower decoration strip, at least one spring and at least one lock hook. The upper decoration strip is fixed on the drawer panel. The lower decoration strip is movably connected with the upper decoration strip by a pivot. The at least one spring is mounted between the upper decoration strip and the lower decoration strip. The at least one lock hook is fixed at the lower decoration strip.

In one embodiment of the drawer stop mechanism provided by the present invention, the upper decoration strip has a hollow structure, comprises a ring-shaped assembling notch, and comprises an upper limiting block and a lower limiting block to limit the movement of the lower decoration strip. The pivot is freely mounted within the ring-shaped assembling notch.

In one embodiment of the drawer stop mechanism provided by the present invention, the lower decoration strip has a hollow structure, and the at least one lock hook is fixed at the lower decoration strip. One end of the spring is fixed at the lower decoration strip, and another end of the spring is connected to the inner side of the upper decoration strip.

In one embodiment of the drawer stop mechanism provided by the present invention, the lower decoration strip has a lap joint. The sliding drawer is locked when the lap joint is engaged with the lower limiting block. The sliding drawer is unlocked when the lap joint is engaged with the upper limiting block.

In one embodiment of the drawer stop mechanism provided by the present invention, the pivot is a round pivot.

In one embodiment of the drawer stop mechanism provided by the present invention, the drawer stop mechanism further comprises two protection cover. One of the protection covers covers one end of the upper decoration strip and the lower decoration strip, and another one of the protection covers covers another end of the upper decoration strip.

The present invention at least has advantages as follows. The least one spring is mounted between the upper decoration strip and the lower decoration strip, so that the lower decoration strip can rotate with respect to the upper decoration strip. In this manner, the at least one lock hook fixed at the lower decoration strip can rotate with the lower decoration strip to lock or unlock the drawer, so that the drawer can be opened or closed. The present invention has a simple structure, is easy to use and can lock the drawer perfectly.

For further understanding of the present invention, reference is made to the following detailed description illustrating the embodiments of the present invention. The description is only for illustrating the present invention, not for limiting the scope of the claim.

DETAILED DESCRIPTION OF THE EMBODIMENTS OF THE INVENTION

Figure 1:
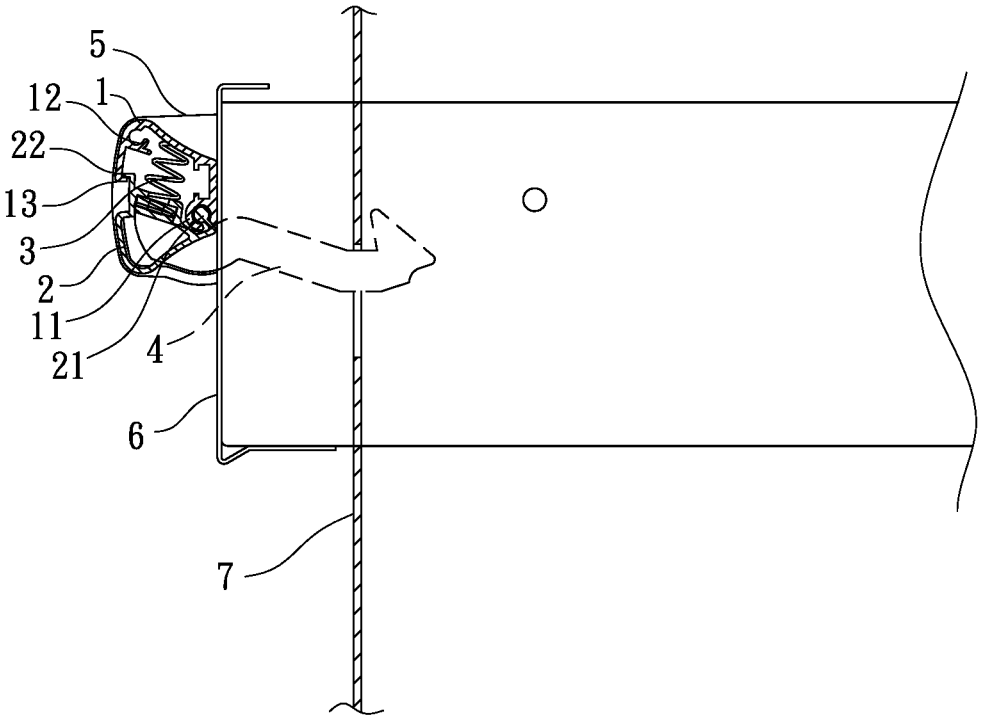
FIG. 1 shows a schematic diagram of a drawer stop mechanism that is locking a sliding drawer of one embodiment of the present invention.

The aforementioned illustrations and following detailed descriptions are exemplary for the purpose of further explaining the scope of the present invention. Other objectives and advantages related to the present invention will be illustrated in the subsequent descriptions and appended drawings.

It will be understood that, although the terms first, second, third, and the like, may be used herein to describe various elements, but these elements should not be limited by these terms. These terms are only to distinguish one element from another region or section discussed below could be termed a second element without departing from the teachings of the present invention. As used herein, the term "and/or" includes any and all combinations of one or more of the associated listed items.

Referring to FIGS. 1-4, there is an embodiment of the drawer stop mechanism for a sliding drawer. The drawer stop mechanism in this embodiment is assembled on a drawer panel 61 of the sliding drawer 6, and comprises an upper decoration strip 1, a lower decoration strip 2, at least one spring 3, at least one lock hook 4 and two protection covers 5.

Figure 2:
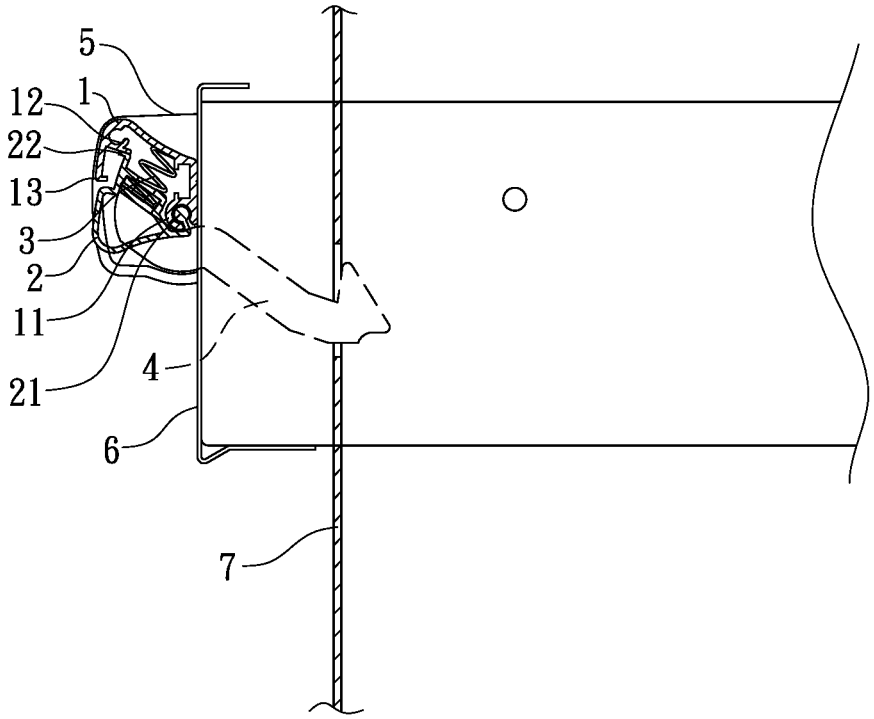
FIG. 2 shows a schematic diagram of a drawer stop mechanism that is unlocking a sliding drawer of one embodiment of the present invention.
Figure 3:
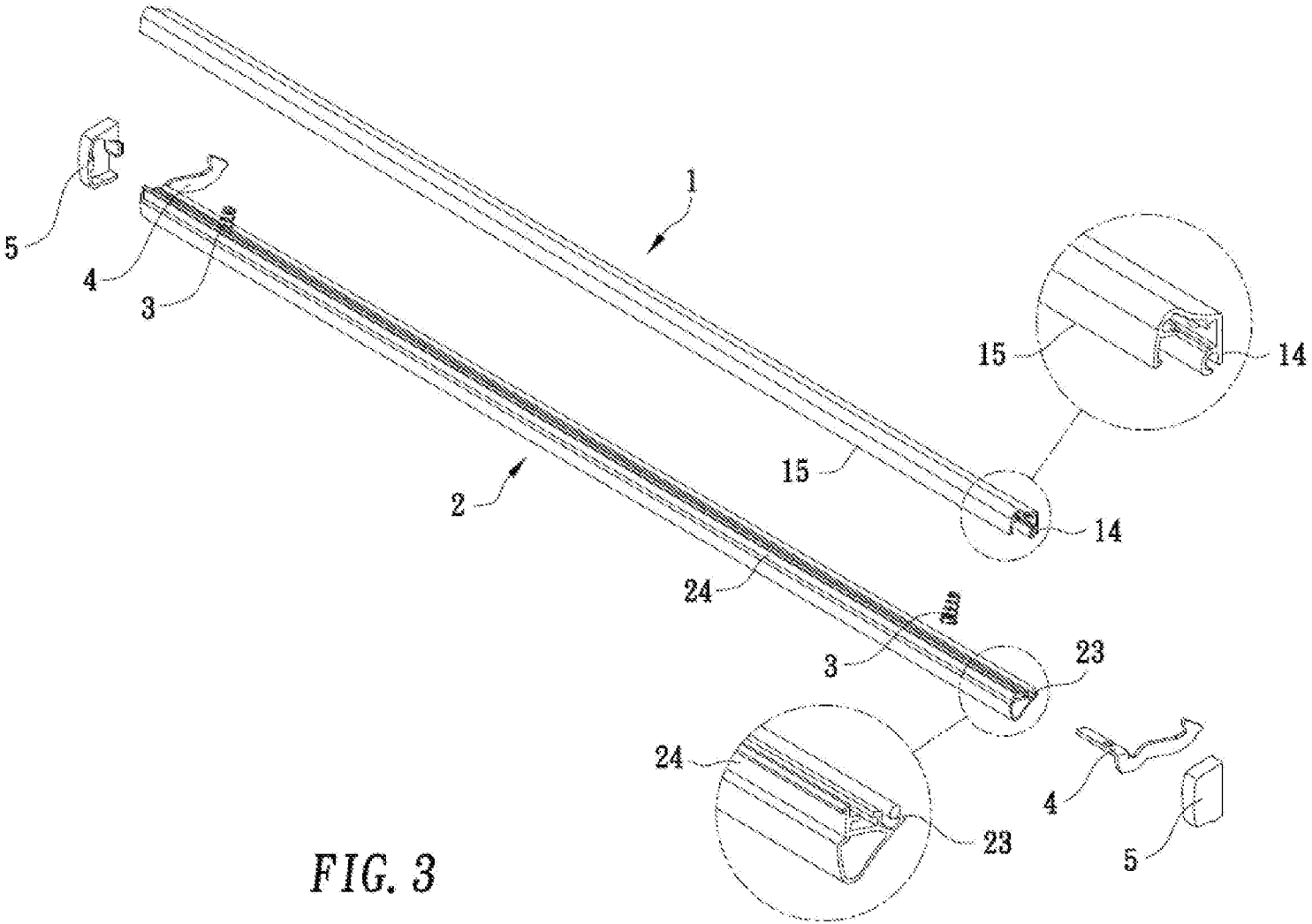
FIG. 3 shows an exploded view of a drawer stop mechanism for a sliding drawer of one embodiment of the present invention.

The upper decoration strip 1 is fixed on the drawer panel 61. The upper decoration strip 1 has a hollow structure and has a first long side 14 and a second long side 15 opposite to the first long side 14. As shown in FIG. 1 and FIG. 2, the upper decoration strip 1 comprises a ring-shaped assembling notch 11, formed at the first long side 14, and comprises an upper limiting block 12 and a lower limiting block 13, both of them are formed at the second long side 15 to limit the movement of the lower decoration strip 2.

The lower decoration strip 2 has a hollow structure and has a third long side 23 and a fourth long side 24 opposite to the third long side 23, and comprises a pivot 21 formed at third long side 23 and a lap joint 22 formed at the fourth long side 24. The pivot 21 is freely mounted within the ring-shaped assembling notch 11, so that the pivot 21 can rotate therein. In this manner, the lower decoration strip 2 is movably connected with the upper decoration strip 1 by the pivot 21.

In this embodiment, the pivot 21 is a round pivot.

The sliding drawer 6 is locked when the lap joint 22 is engaged with the lower limiting block 13, as shown in FIG. 1. The sliding drawer 6 is unlocked when the lap joint 22 is engaged with the upper limiting block 12, as show in FIG. 2.

In this embodiment, the at least one lock hook 4 is fixed at the lower decoration strip 2.

The at least one spring 3 is mounted between the upper decoration strip 1 and the lower decoration strip 2. As shown in FIG. 1 and FIG. 2, for each spring 3, one end of the spring 3 is fixed at the lower decoration strip 2, and another end of the spring 3 is connected to the inner side of the upper decoration strip 1.

One of the protection covers 5 covers one end of the upper decoration strip 1 and the lower decoration strip 2 and another one of the protection covers 5 covers another end of the upper decoration strip 1 and the lower decoration strip 2, to stop the upper decoration strip 1 and the lower decoration strip 2 from moving. The upper decoration strip 1, the lower decoration strip 2 and the protection covers 5 form a closed hollow structure.

Figure 4:
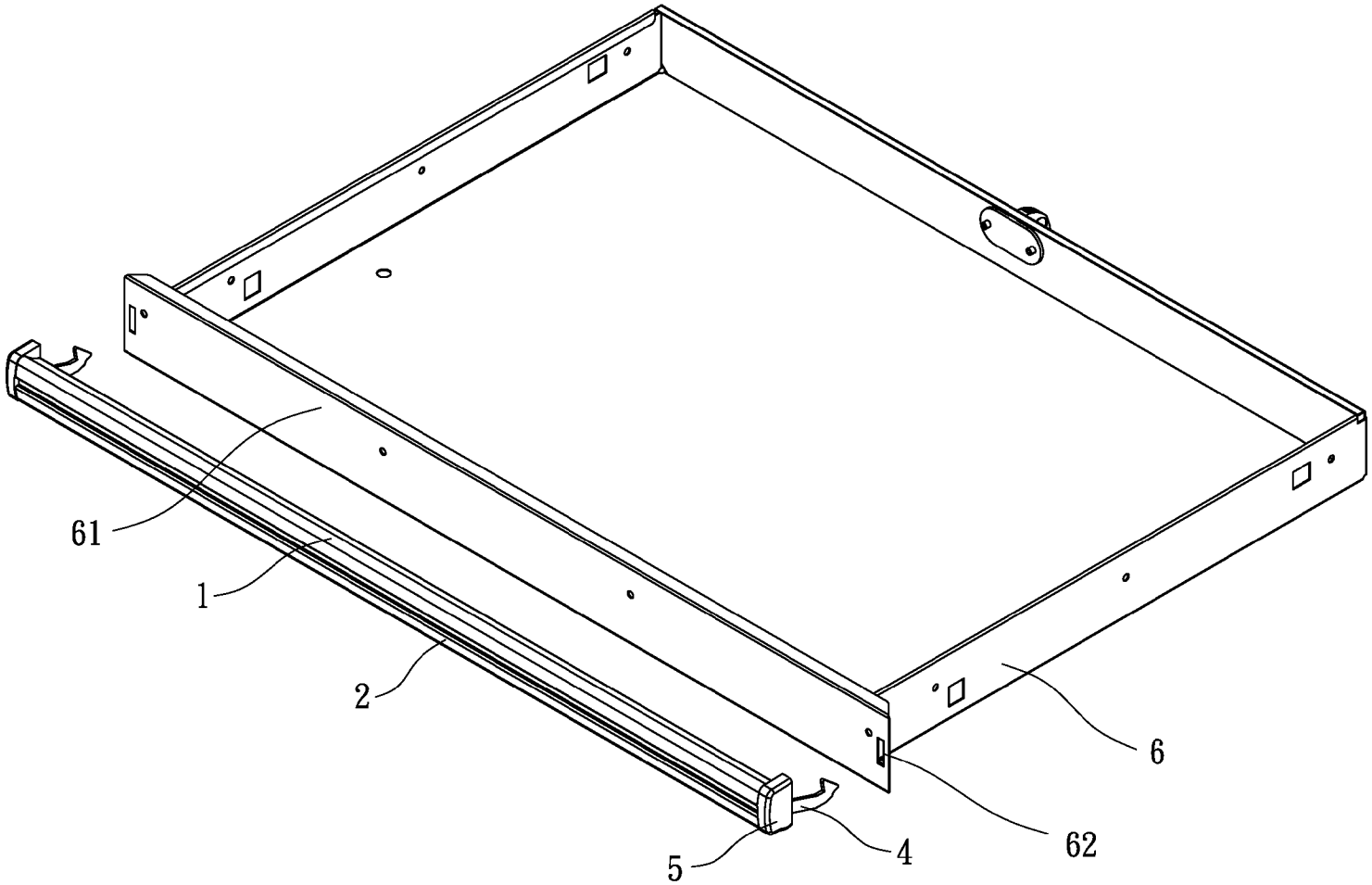
FIG. 4 shows a schematic diagram showing how to assemble a drawer stop mechanism on a sliding drawer of one embodiment of the present invention.

To assemble the drawer stop mechanism on the sliding drawer 6, as shown in FIG. 1, FIG. 2 and FIG. 4, the drawer panel 61 of the sliding drawer 6 has locking holes 62 at its two sides, and the locking holes 62 can be seen just outside the cabinet 7. Each lock hook 4 is corresponding to a locking hole 62, and each lock hook 4 can be engaged with the corresponding locking hole 62. When the sliding drawer 6 is pushed, it will be automatically locked by the lock hooks 4. On the other hand, the sliding drawer 6 can be unlocked by slightly lifting up the lower decoration strip 2. As shown in FIG. 1, when the sliding drawer 6 is locked by the lock hooks 4, the springs 3 are released, the lap joint 22 is engaged with the lower limiting block 13 and thus the lock hooks 4 can tightly lock the drawer 6 of the cabinet 7. As shown in FIG. 2, the springs 3 are compressed, and the lower decoration strip 2 rotates, with respect to the upper decoration strip 1, about the pivot 21. In this manner, the lap joint 22 rotates upward with the lower decoration strip 2 and becomes engaged with the upper limiting block 12. At the same time, the lock hooks 4 also rotate with the lower decoration strip 2, so that the lock hooks 4 move downward and then unlock the drawer 6 of the cabinet 7. According to the above, the sliding drawer 6 can be closed and opened.

The present invention provides a drawer stop mechanism for a sliding drawer. In the present invention, at least one spring is mounted between the upper decoration strip and the lower decoration strip, so that the lower decoration strip can rotate with respect to the upper decoration strip. In this manner, the at least one lock hook fixed at the lower decoration strip rotates with the lower decoration strip to lock or unlock the drawer, so that the drawer can be opened or closed. The present invention has a simple structure, is easy to use and can lock the drawer perfectly.

The features of the present invention are disclosed above by the preferred embodiment to allow persons skilled in the art to gain insight into the contents of the present invention and implement the present invention accordingly. The preferred embodiment of the present invention should not be interpreted as restrictive of the scope of the present invention. Hence, all equivalent modifications or amendments made to the aforesaid embodiment should fall within the scope of the appended claims.

What is claimed is:

1. A drawer stop mechanism for a sliding drawer, assembled on a drawer panel of the sliding drawer, comprising:

an upper decoration strip having a first long side and a second long side opposite to the first long side;

a lower decoration strip having a third long side and a fourth long side opposite to the third long side and movably connected with the upper decoration strip by a pivot formed at the third long side;

at least one spring mounted between the upper decoration strip and the lower decoration strip;

at least one lock hook fixed at the lower decoration strip; and two protection covers, one of the protection covers covering one end of the upper decoration strip and the lower decoration strip, and another one of the protection covers covering another end of the upper decoration strip and the lower decoration strip;

wherein the upper decoration strip is formed as a hollow structure, the upper decoration strip has a ring-shaped assembling notch formed at the first long side and an upper limiting block and a lower limiting block, the upper and lower limiting blocks formed at the second long side and configured to limit the movement of the lower decoration strip, and the pivot being mounted within the ring-shaped assembling notch, wherein the lower decoration strip is formed as a hollow structure and has a lap joint formed at the fourth long side, the sliding drawer being configured to be locked when the lap joint is engaged with the lower limiting block and unlocked when the lap joint is engaged with the upper limiting block, and wherein the upper decoration strip, the lower decoration strip and the protection covers form a closed hollow structure.

2. The drawer stop mechanism according to claim 1, wherein the at least one lock hook is fixed at the lower decoration strip, one end of the spring is fixed at the lower decoration strip, and another end of the spring is connected to the inner side of the upper decoration strip.

3. The drawer stop mechanism according to claim 1, wherein the sliding drawer is locked when the lap joint is engaged with the lower limiting block, and the sliding drawer is unlocked when the lap joint is engaged with the upper limiting block.

4. The drawer stop mechanism according to claim 1, wherein the pivot is a round pivot.

* * * * *